US010209020B2

(12) United States Patent
Bair

(10) Patent No.: US 10,209,020 B2
(45) Date of Patent: Feb. 19, 2019

(54) SEMI-AUTOMATIC FIREARM RAPID-FIRE ACCESSORY

(71) Applicant: Dennis Michael Bair, Reston, VA (US)

(72) Inventor: Dennis Michael Bair, Reston, VA (US)

( * ) Notice: Subject to any disclaimer, the term of this patent is extended or adjusted under 35 U.S.C. 154(b) by 0 days.

(21) Appl. No.: 15/967,181

(22) Filed: Apr. 30, 2018

(65) Prior Publication Data

US 2018/0313623 A1 Nov. 1, 2018

(51) Int. Cl.

| | |
|---|---|
| ***F41A 3/00*** | (2006.01) |
| ***F41A 19/09*** | (2006.01) |
| ***F41A 19/11*** | (2006.01) |
| *F41C 7/00* | (2006.01) |
| *F41A 35/06* | (2006.01) |

(52) U.S. Cl.

CPC ..... *F41A 19/09* (2013.01); *F41A 19/11* (2013.01); *F41A 35/06* (2013.01); *F41C 7/00* (2013.01)

(58) Field of Classification Search

CPC ..... F41A 19/09; F41A 35/06; F41C 23/06; F41C 27/00; F41C 35/06

See application file for complete search history.

(56) References Cited

U.S. PATENT DOCUMENTS 2,383,044 A * 8/1945 Craig ..... F41A 19/09 42/69.01
4,787,288 A * 11/1988 Miller ..... F41A 19/02 89/136
5,780,762 A * 7/1998 Kobayashi ..... F41A 19/33 89/136
7,273,002 B1 * 9/2007 Rogers ..... F41A 19/09 89/142
2013/0074685 A1 * 3/2013 Cottle ..... F41A 19/06 89/27.11
2015/0308785 A1 * 10/2015 Marcotte ..... F41A 23/16 89/128

* cited by examiner

*Primary Examiner* — Gabriel J. Klein
(74) *Attorney, Agent, or Firm* — The Marbury Law Group, PLLC

(57) ABSTRACT

Devices, systems, and methods of manufacturing are disclosed with regard to a rapid-fire accessory that mounts onto a semi-automatic firearm using structural features thereof and/or added thereon to guide a trigger actuator for engaging a trigger and repeatedly firing the semi-automatic firearm. The rapid-fire accessory does not require the removal or replacement of the original, replacement, or aftermarket firearm grip or most other components of the firearm. The rapid-fire accessory provides a structural component an operator may hold that facilitates bump firing the semi-automatic firearm. Once mounted on the semi-automatic firearm, the rapid-fire accessory may slide rearward and forward, using a bottom rail on or below a forend of the semi-automatic firearm as a guiding surface and securing element. The rapid-fire accessory also includes a forward-hand grip for comfortably and securely holding the rapid-fire accessory steady, while the semi-automatic firearm is pushed forward and then recoils backward from discharging.

14 Claims, 11 Drawing Sheets

SEMI-AUTOMATIC FIREARM RAPID-FIRE ACCESSORY

CROSS-REFERENCE TO RELATED PATENT APPLICATIONS

This patent application claims the benefit of and priority to U.S. Provisional Patent Application No. 62/492,913 filed on May 1, 2017, the entire contents of which are hereby incorporated by reference.

BACKGROUND

Various techniques and devices increase the firing rate of a semi-automatic firearm. Bump firing is a technique of firing a semi-automatic firearm using the recoil energy from firing the weapon to rapid-fire faster than what an operator could achieve by repeated finger pulls.

Operators may bump fire a semi-automatic firearm without the use of tools, accessories, or alterations to the weapon, but such freehand techniques are difficult to master. To execute a freehand technique, the operator generally holds the semi-automatic firearm away from his or her body in order to allow the weapon to recoil after firing. One freehand technique has the operator hold a trigger hand in a rigid position with a trigger finger just in front of the trigger while placing a forend hand (i.e., the other hand) on a hand-guard of the weapon. The hand-guard generally covers the barrel of the semi-automatic firearm, which is forward of the trigger (i.e., at the forend). Using the forend hand to push the hand-guard forward, while maintaining the trigger hand in the rigid position, the semi-automatic firearm shifts forward relative to the trigger hand. This forward movement causes the trigger to engage the trigger finger, which if held firmly in the rigid position will discharge the semi-automatic firearm. Recoil from the discharge of a bullet pushes the semi-automatic firearm rearwards away from the trigger finger, allowing the trigger to re-set. If the operator maintains a forward force on the hand-guard while keeping the trigger hand stationary in the rigid position (i.e., pulling the forend hand away from the trigger hand), the operator will be able to once again push the hand-guard forward after the recoil energy dissipates, which once again discharges the weapon. By continuously maintaining the forward force on the hand-guard with the trigger hand in the rigid position, the weapon will discharge in a rapid-fire succession that is generally faster than what the operator can achieve with repeated finger pulls. Not all operators that attempt this technique are successful or consistently successful.

SUMMARY

Devices, systems, and methods of various embodiments are disclosed including a rapid-fire accessory for a semi-automatic firearm. The rapid-fire accessory may include a trigger actuator and a forend rail mount for attaching the rapid-fire accessory to the semi-automatic firearm. The forend rail mount may include a mounting channel for receiving an accessory rail extending along a forend of the semi-automatic firearm. When mounted in the mounting channel, the accessory rail may guide a sliding movement of the rapid-fire accessory along the accessory rail. The trigger actuator may pull a trigger of the semi-automatic firearm. The trigger actuator may move in unison with the sliding movement of the forend rail mount and be configured to move the trigger rearward from a forward position to a pulled position that discharges the semi-automatic firearm.

In some embodiments, an actuator support structure may extend rearward from a distal end closest to the forend rail mount to a proximal end closest to the trigger. In addition, a trigger bar may be supported by the actuator support structure and extend laterally across the trigger from one side of the semi-automatic firearm to an opposed side of the semi-automatic firearm. The actuator support structure may include a first support arm disposed on the one side of the semi-automatic firearm and a second support arm disposed on the opposed side of the semi-automatic firearm. The first and second support arms may support the trigger bar. The trigger bar may be secured to the first support arm and the second support arm.

In some embodiments, the rapid-fire accessory may include a magazine well bracket configured to wrap around a magazine well of the semi-automatic firearm. The magazine well bracket may be disposed between the magazine well and the actuator support structure. The magazine well bracket may include a guide track for guiding the sliding movement of the rapid-fire accessory. The sliding movement of the trigger actuator may move relative to the magazine well bracket and the magazine well. The trigger bar may be removably secured to the actuator support structure. An inner cross-sectional shape of the mounting channel may conform to an outer cross-sectional shape of the accessory rail. Opposed lower portions of the mounting channel may bulge outwardly forming opposed longitudinal grooves for receiving opposed lateral flanges on a lower portion of the accessory rail. The forend rail mount may include a forward hand grip surface configured to receive a forward hand of an operator of the semi-automatic firearm while the operator holds a pistol grip of the semi-automatic firearm with a rearward hand. The forend rail mount may include a supplemental accessory rail protruding from a lower side of the forend rail mount. The supplemental accessory rail may include a matching outer profile to the accessory rail received by the mounting channel. The forend rail mount may include at least one finger grip contour.

Various embodiments include a method of mounting a rapid-fire accessory on a trigger guard of a semi-automatic firearm. The method may include mounting a forend rail mount of the rapid-fire accessory onto an accessory rail of the semi-automatic firearm. The accessory rail may extend along a forend of the semi-automatic firearm, wherein once the forend rail mount is mounted on the accessory rail, the accessory rail may be disposed in a mounting channel of the forend rail mount. The mounting channel may guide a sliding movement of the forend rail mount forward and rearward relative to the forend. The rapid-fire accessory may include a trigger actuator for engaging a trigger of the semi-automatic firearm. The trigger actuator may be fixed relative to the forend rail mount and configured to pull the trigger when the forend slides forward in the mounting channel.

In some embodiments, a trigger bar may be secured to an actuator support structure of the trigger actuator. The actuator support structure may extend rearward from a distal end closest to the forend rail mount to a proximal end closest to the trigger. The trigger bar, once secured to the actuator support structure, may extend laterally across the trigger from one side of the semi-automatic firearm to an opposed side of the semi-automatic firearm.

BRIEF DESCRIPTION OF THE DRAWINGS

The accompanying drawings, which are incorporated herein and constitute part of this specification, illustrate example embodiments of the invention, and together with the general description given above and the detailed description given below, serve to explain the features of the invention.

DETAILED DESCRIPTION

Figure 1:
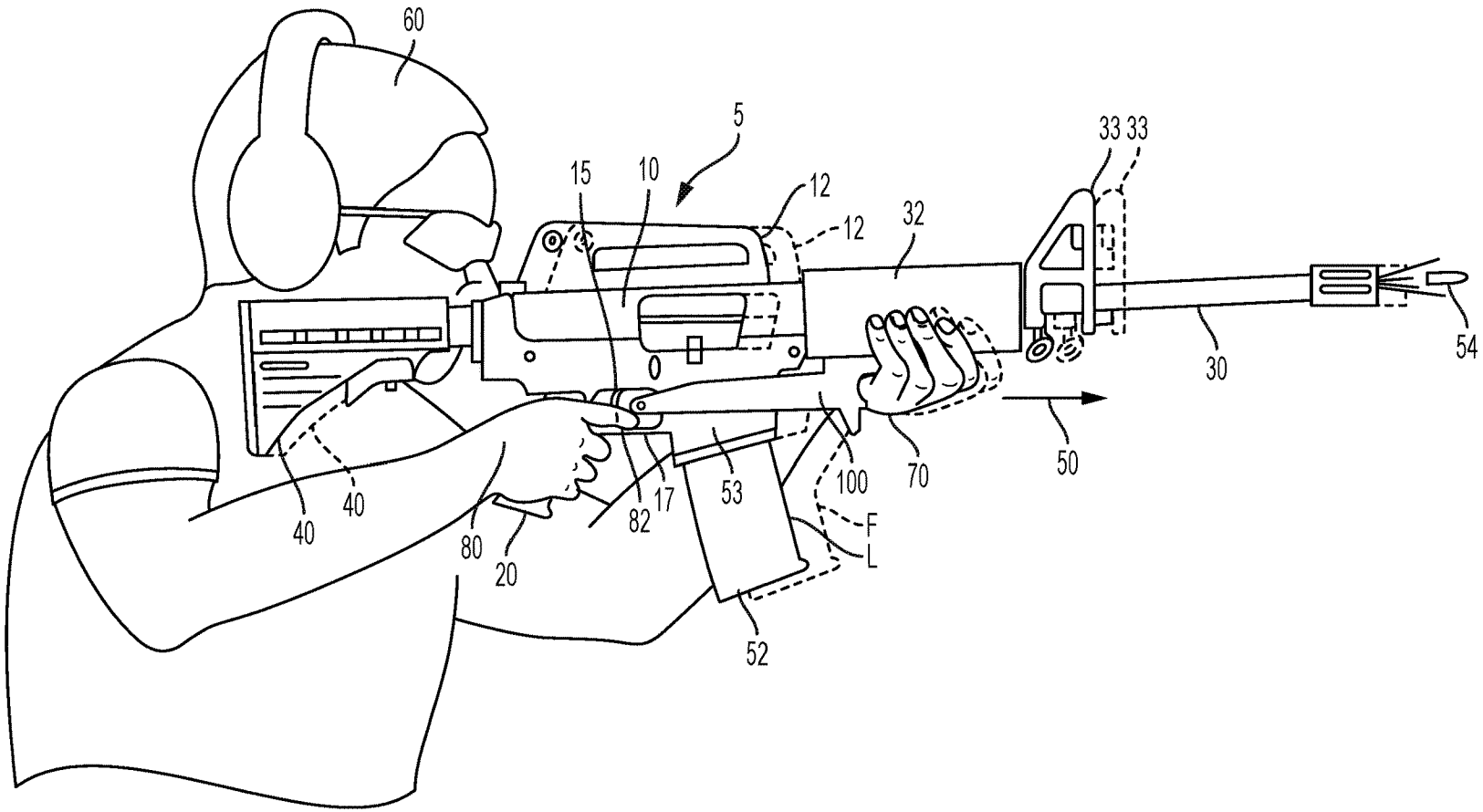
FIG. 1 illustrates a right side view of an operator firing a semi-automatic firearm using a rapid-fire accessory in accordance with various embodiments.

Various embodiments will be described in detail with reference to the accompanying drawings. Wherever possible the same reference numbers will be used throughout the drawings to refer to the same or like parts. References made to particular examples and implementations are for illustrative purposes, and are not intended to limit the scope of the invention or the claims.

Various embodiments include a rapid-fire accessory that mounts onto a semi-automatic firearm using structural features thereof and/or added thereon to guide a trigger actuator for engaging a trigger and repeatedly firing the semi-automatic firearm. The rapid-fire accessory does not require the removal or replacement of the original, replacement, or aftermarket firearm grip or most other components of the firearm. The rapid-fire accessory provides a structural component an operator may hold that facilitates bump firing the semi-automatic firearm. Once mounted on the semi-automatic firearm, the rapid-fire accessory may slide rearward and forward, using a bottom rail on or below a forend of the semi-automatic firearm as a guiding surface and securing element. The rapid-fire accessory also includes a forward-hand grip for comfortably and securely holding the rapid-fire accessory steady, while the semi-automatic firearm is pushed forward and then recoils backward from discharging.

The term "semi-automatic firearm" as used herein refers generally to a portable gun configured to self-load by performing all the steps necessary to prepare the weapon to discharge again after firing. A semi-automatic firearm comprises a barreled weapon that launches a series of bullets driven by the action of an explosive force such as gunpowder. A semi-automatic firearm may include any one or all of rifles, shotguns, carbines, and even long-barrel handguns that include a hand-guard on the barrel (i.e., forend) and are suitable for bump firing. Semi-automatic firearms include a receiver into which a cartridge is loaded that holds each bullet until fired. In addition, semi-automatic firearms include a barrel, extending from the receiver, and a trigger assembly for firing the weapon. The barrel and/or the receiver may be mounted in or integrally formed into a stock made of wood, plastic, metal, composite, or any combination thereof. Semi-automatic firearms generally include various grip surfaces such as the hand-guard on the barrel, a butt stock to place against an operator's shoulder, and/or an intermediate grip surface.

The term "trigger" as used herein refers generally to a lever or button mechanism that actuates the firing sequence of a semi-automatic firearm. A trigger may directly or indirectly cause the release of powerful energy (i.e., an explosion) that propels a bullet from the weapon. Triggers are generally configured to be actuated by an index finger, which may also be referred to as the trigger finger, although other fingers may be used. The term "trigger guard" as used herein refers to a structural element that is part of the semi-automatic firearm, such as an original, replacement, or aftermarket part thereof. The trigger guard blocks direct engagement of the trigger from at least below the semi-automatic firearm, which generally requires an operator to approach the trigger with a trigger finger from one of the lateral sides.

The term "accessory rail" as used herein in conjunction with a forend refers generally to a bracket fixedly attached to the forend (e.g., the barrel hand-guard) of a firearm. The accessory rail provides a standard mounting platform, in the form of a longitudinally extending rail, fixed to and extending along the forend. For example, the accessory rail may be a Picatinny rail (i.e., MIL-STD-1913 rail), Weaver rail, or the like. The accessory rail may or may not include a series of laterally extending recoil grooves or slots.

The term "operator" as used herein refers generally to a person who uses and controls the semi-automatic firearms. An operator generally uses two hands to bump fire a semi-automatic firearm. One hand may hold a forward portion of the semi-automatic firearm, such as around or near the forend, which hand is referred to herein as the "forward hand." The other hand, used to hold the pistol grip or at least part of the semi-automatic firearm near the trigger, is referred to herein as the "rearward hand."

In various embodiments, the rapid-fire accessory is illustrated and described with a symmetrical design suitable for either a right-handed or left-handed operator. It should be understood that various embodiments may be ergonomically modified when forming a rapid-fire accessory to better accommodate an operator.

FIG. 1 illustrates a side view of an operator 60 holding a rapid-fire accessory 100 mounted on a semi-automatic firearm 5, in accordance with various embodiments. The semi-automatic firearm 5 illustrated is an AR-15 style weapon that includes a receiver 10, a trigger 15, a trigger guard 17, a pistol grip 20, a barrel 30, a forend 32, and a stock 40. The semi-automatic firearm 5 may include a magazine 52 for holding ammunition (i.e., bullets 54). The magazine 52 is removably secured within a magazine well 53 configured to receive and hold in-place the magazine 52. Other features common to an AR-15 style weapon as well as other semi-automatic firearms are illustrated, such as a carrying handle 12 and a front site 33.

In FIG. 1, the operator 60 is holding the rapid-fire accessory 100 and the forend 32 using forward hand 70 (i.e., a left hand). The left hand when located forward of the right hand is herein referred to as a "forward hand." Also, a rearward hand 80 (i.e., a right hand) is holding the pistol grip 20. The right hand when rearward of the left hand is herein referred to as a "rearward hand."

Additionally, in FIG. 1 the semi-automatic firearm 5 and parts thereof are illustrated in a loaded configuration using solid lines (indicated as "L"). From the loaded configuration, the operator 60 may push the semi-automatic firearm 5 forward, while holding the rapid-fire accessory 100 stationary, such that the semi-automatic firearm 5 moves into a fired configuration (indicated as "F") and which is illustrated using dotted lines. In the orientation illustrated in FIG. 1, the semi-automatic firearm 5 is aiming to the right, which is referred to herein as a "forward" direction, as opposed to a "rearward" direction aiming to the left.

Figure 2A:
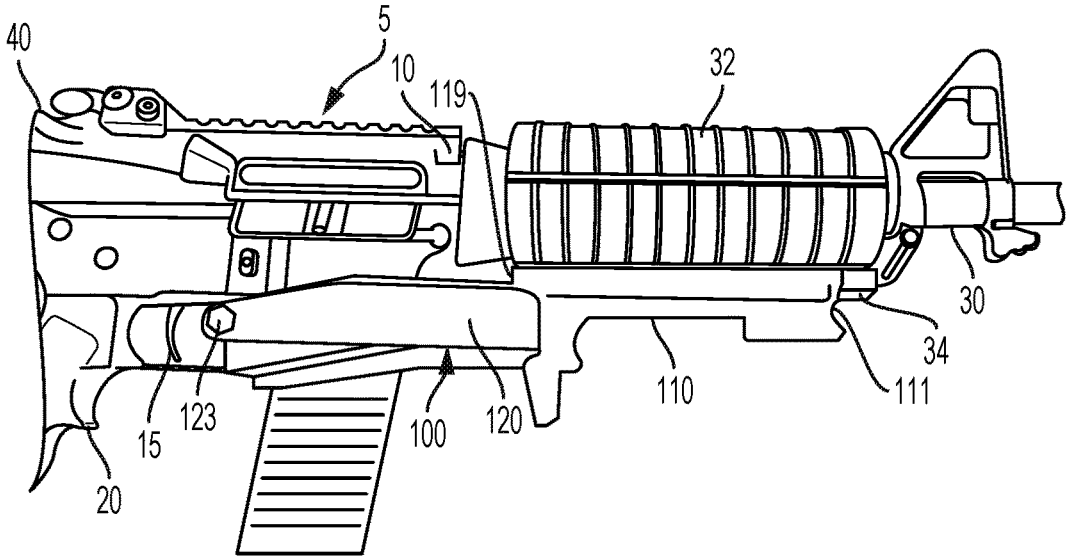
FIG. 2A illustrates a close-up view of the semi-automatic firearm of FIG. 1, in the loaded configuration using a rapid-fire accessory in accordance with various embodiments.
Figure 2B:
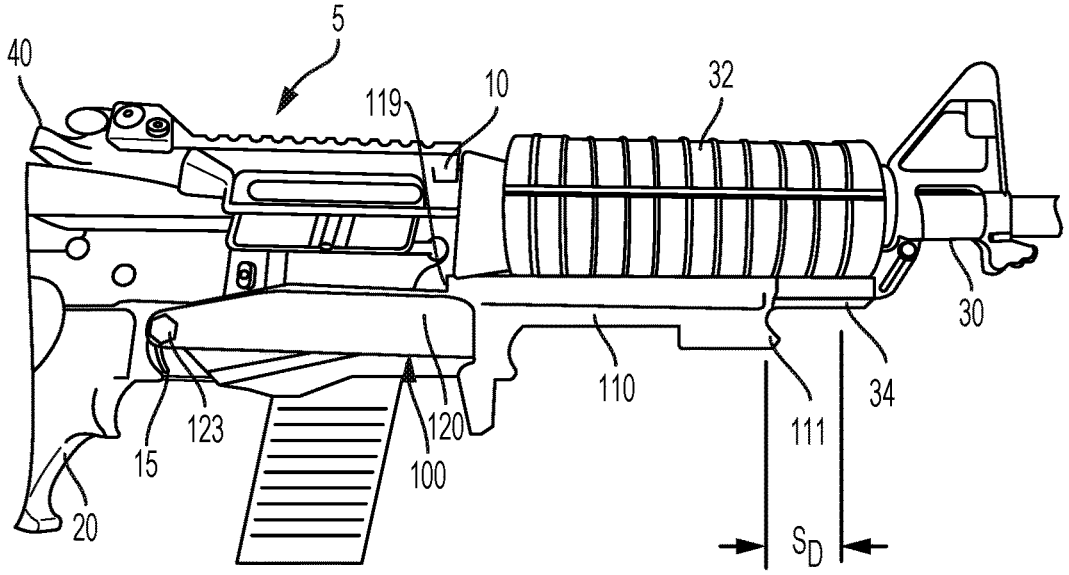
FIG. 2B illustrates a close-up view of the semi-automatic firearm of FIGS. 1 and 2A, in the fired configuration using a rapid-fire accessory in accordance with various embodiments.

FIGS. 2A and 2B illustrate close-up views of the rapid-fire accessory 100 mounted on the semi-automatic firearm 5 of FIG. 1. In FIG. 2A, the semi-automatic firearm 5 is in a "loaded" configuration, with the trigger 15 of the semi-automatic firearm 5 in a forward position. From the loaded configuration, pulling the trigger 15 (i.e., pivoting or moving the trigger 15 rearward—toward the left as illustrated) will discharge the semi-automatic firearm 5. In contrast in FIG. 2B, the semi-automatic firearm 5 is in a "fired" configuration, with the trigger 15 in a rearward position. From the loaded configuration (e.g., FIG. 2A), to bump fire in accordance with various embodiments, an operator holds the rapid-fire accessory 100 in a relatively fixed position while pushing the semi-automatic firearm 5 forward into the fired configuration (e.g., FIG. 2B), which discharges the semi-automatic firearm 5. The semi-automatic firearm 5 sliding forward relative to the rapid-fire accessory 100 also means the rapid-fire accessory 100 slides rearward relative to the semi-automatic firearm 5 between the loaded and fired configurations. This relative sliding movement causes the trigger actuator 123 to engage a forward side of the trigger 15, pushing the trigger 15 rearward (i.e., "pulling the trigger"), which discharges the semi-automatic firearm 5. Alternatively, to bump fire in accordance with various embodiments, starting from the loaded configuration (e.g., FIG. 2A) an operator may hold the semi-automatic firearm 5 in a relatively fixed position, while pulling the rapid-fire accessory 100 rearward, until the semi-automatic firearm 5 is in the fired configuration (e.g., FIG. 2B), which discharges the semi-automatic firearm 5.

With reference to FIGS. 1-2B, the rapid-fire accessory 100 includes a forend rail mount 110 for attaching the rapid-fire accessory 100 to the semi-automatic firearm 5. The forend rail mount 110 is a forward portion of the rapid-fire accessory 100, which attaches to the semi-automatic firearm 5 by sliding or otherwise mounting the forend rail mount 110 onto an accessory rail 34 of the forend 32 of the semi-automatic firearm 5, for weapons that include the lower rail. The forend rail mount 110 includes a longitudinally mounting channel (e.g., mounting channel 140 in FIGS. 7B and 8B) for receiving the lower rail of the semi-automatic firearm 5. In particular, an open end 119 of the forend rail mount 110 may form a receiving aperture through which the accessory rail 34 may be inserted into the mounting channel.

The rapid-fire accessory 100 additionally includes a trigger actuator 123 for pulling a trigger 15 of the semi-automatic firearm 5. The trigger actuator 123 is fixed relative to the forend rail mount 110 by an actuator support structure 120, which extends rearward from the open end 119 of the forend rail mount 110 toward the trigger 15. The forend rail mount 110 may be fixedly secured to or integrally formed with the actuator support structure 120. Together, the forend rail mount 110 and the actuator support structure 120 may collectively be referred to as the "rapid-fire base structure." Thus, when the operator holds the pistol grip 20 and pushes the semi-automatic firearm 5 forward (i.e., to the right in the configuration shown) while holding the rapid-fire accessory 100 stationary, the accessory rail 34 also slides forward relative to the forend rail mount 110. The trigger actuator 123 is configured to engage a forward side of the trigger 15, applying a rearward force thereon, until the trigger 15 pivots enough to fire the semi-automatic firearm 5. In this way, the rapid-fire accessory 100 moves a sliding distance $S_D$ from the loaded configuration (i.e., FIG. 2A) to the fired configuration (i.e., FIG. 2B). FIG. 2B illustrates the sliding distance $S_D$ as a distance moved by a leading edge 111 of the forend rail mount 110.

Figure 3A:
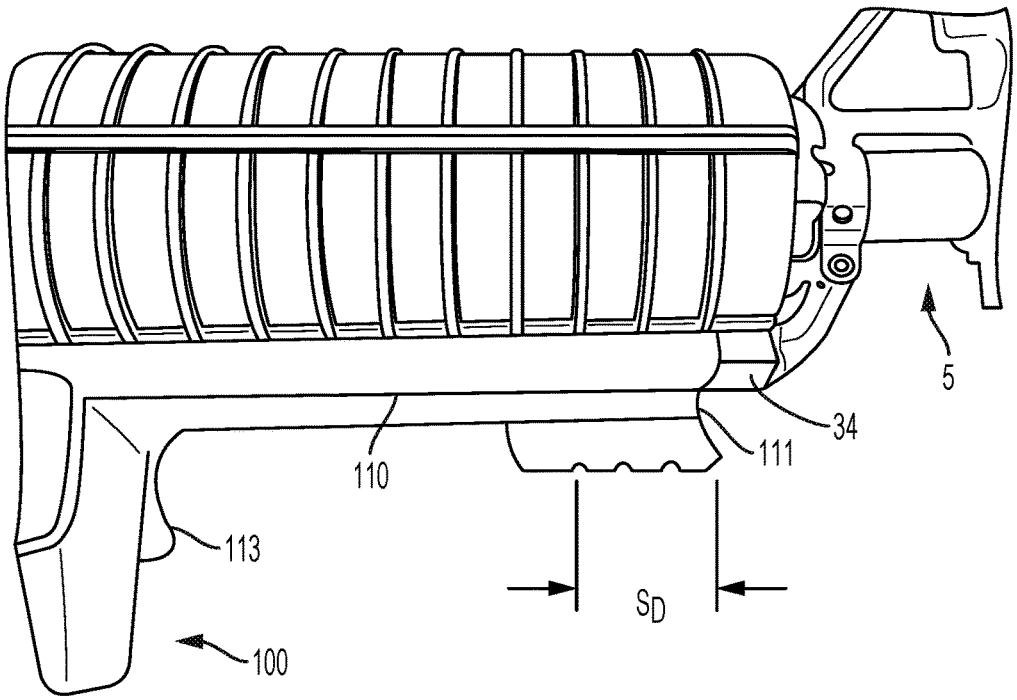
FIG. 3A illustrates a further close-up view of forward portions of the rapid-fire accessory on the semi-automatic firearm in the loaded configuration of FIG. 2A, in accordance with various embodiments.
Figure 3B:
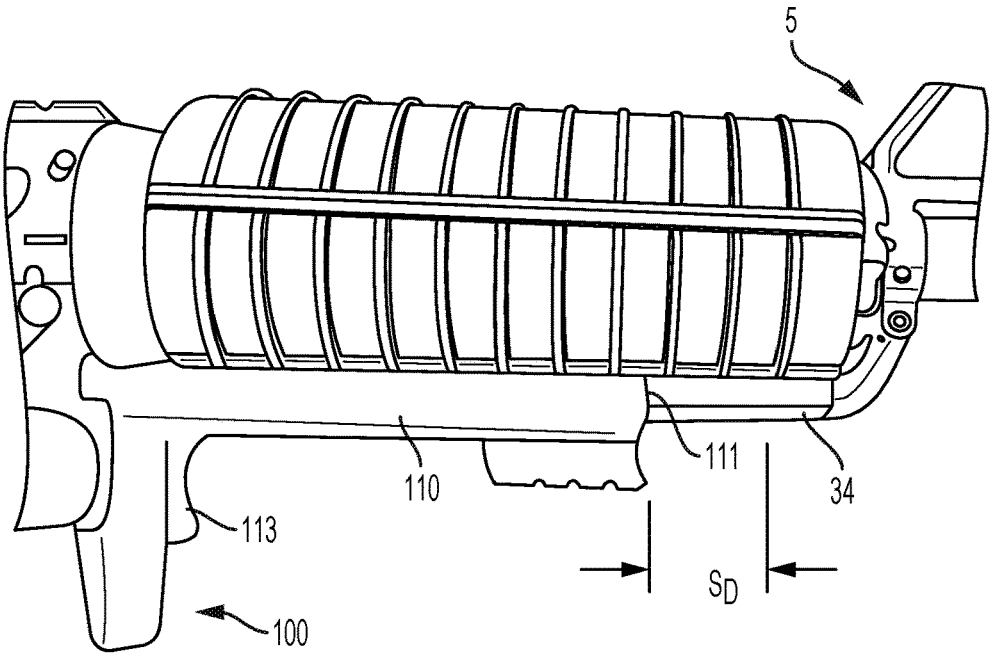
FIG. 3B illustrates a further close-up view of forward portions of the rapid-fire accessory on the semi-automatic firearm in the fired configuration of FIG. 2B, in accordance with various embodiments.

FIGS. 3A and 3B are close-up views of a forward portion of the rapid-fire accessory 100 mounted on the semi-automatic firearm 5, shown in FIGS. 1-2B, in accordance with various embodiments. The forward portion of the rapid-fire accessory 100 includes the forend rail mount 110. FIG. 3A illustrates the semi-automatic firearm 5 in the loaded configuration, while FIG. 3B illustrates the semi-automatic firearm 5 in the fired configuration, corresponding to FIGS. 2A and 2B, respectively.

In accordance with various embodiments, the operator (e.g., operator 60 in FIG. 1) may hold the rapid-fire accessory 100 by grabbing onto the forend rail mount 110. In particular, the operator may wrap a forward hand, or fingers on that hand, around an underside of the forend rail mount 110. Different operators may have different preferences on how to hold the forend rail mount 110. Thus, in accordance with various embodiments, the forend rail mount 110 may include various different hand grip surfaces. For example, the leading edge 111 of the forend rail mount 110 may include a contour for resting a finger, such as an index finger. In addition, a more central section of the forend rail mount 110 may include a longer hand grip surface for accommodating more than one finger, such as the middle, ring, and/or pinky fingers. Further, a forward-facing edge 113 on a rear portion of the bottom side of the forend rail mount 110 may also include a pinky grip contour to provide support and comfort for an operator's pinky finger. The operator's pinky finger may engage (i.e., slide-up against) the forward-facing edge 113 when gripping (i.e., holding still) the rapid-fire accessory 100. When using the rapid-fire accessory 100 to bump fire the semi-automatic firearm, the operator may try to avoid wrapping a thumb on the forward hand around the forend 32, since the forend 32 will slide relative to forend rail mount 110.

The forend rail mount 110, when mounted on the accessory rail 34, is configured to guide sliding movements of the forend rail mount 110, and the overall rapid-fire accessory 100, relative to the semi-automatic firearm 5. A first sliding movement may occur in a first relative direction when the operator holds the rapid-fire accessory 100 still, while pushing the semi-automatic firearm 5 forward until the semi-automatic firearm 5 discharges. In this way, the semi-automatic firearm 5 may shift forward, relative to the rapid-fire accessory 100, a sliding distance $S_D$ when being moved from the loaded configuration to the fired configuration. In response to the discharge, a second sliding movement may occur in a second relative direction, opposite the first relative direction, when the operator continues to holds the rapid-fire accessory 100 relatively still as the semi-automatic firearm 5 recoils in a rearward direction.

With the operator continuing to hold the rapid-fire accessory 100 in a relatively fixed position, the recoil force caused by the discharge of the semi-automatic firearm 5 slides the semi-automatic firearm 5 rearward relative to the rapid-fire accessory 100, which returns the semi-automatic firearm 5 to the loaded configuration (e.g., FIGS. 2A and 3A). Once the semi-automatic firearm 5 returns to the loaded configuration, if the operator maintains a steady forward-pushing force on the semi-automatic firearm 5, once again sliding the semi-automatic firearm 5 forward relative to the rapid-fire accessory 100, the semi-automatic firearm 5 will discharge in a rapid-fire succession like that of freehand bump fire techniques. However, unlike freehand bump fire techniques, use of the rapid-fire accessory 100 is easier to operate and does not involve elaborate and/or expensive accessories.

Figure 4A:
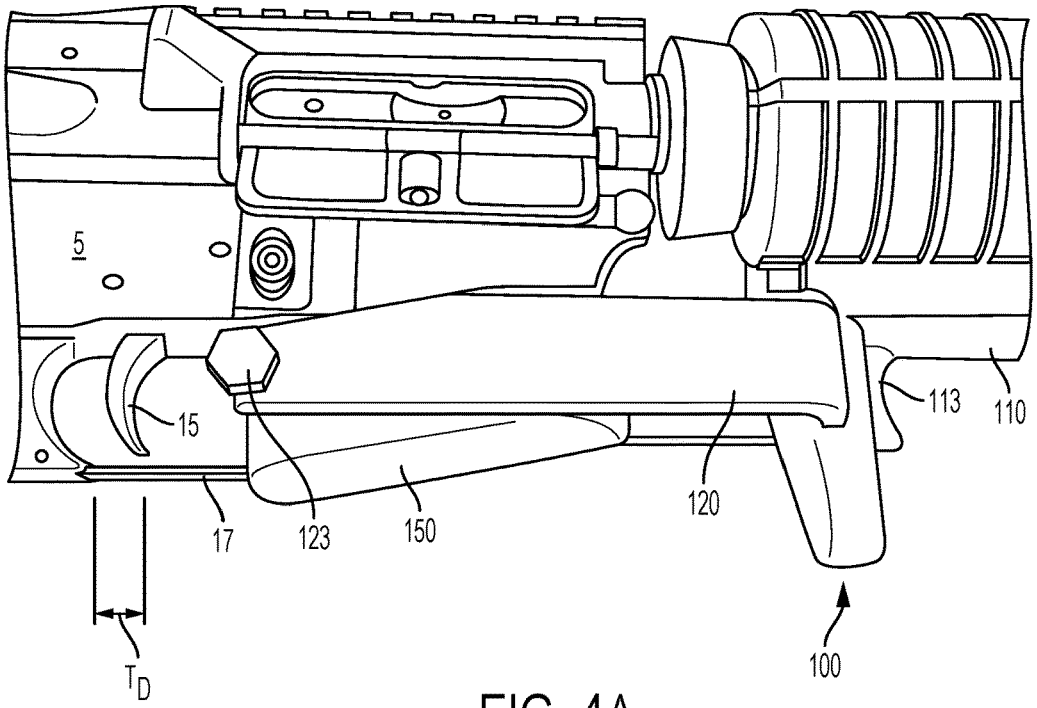
FIG. 4A illustrates a further close-up view of rear portions of the rapid-fire accessory on the semi-automatic firearm in the loaded configuration of FIG. 2A, in accordance with various embodiments.
Figure 4B:
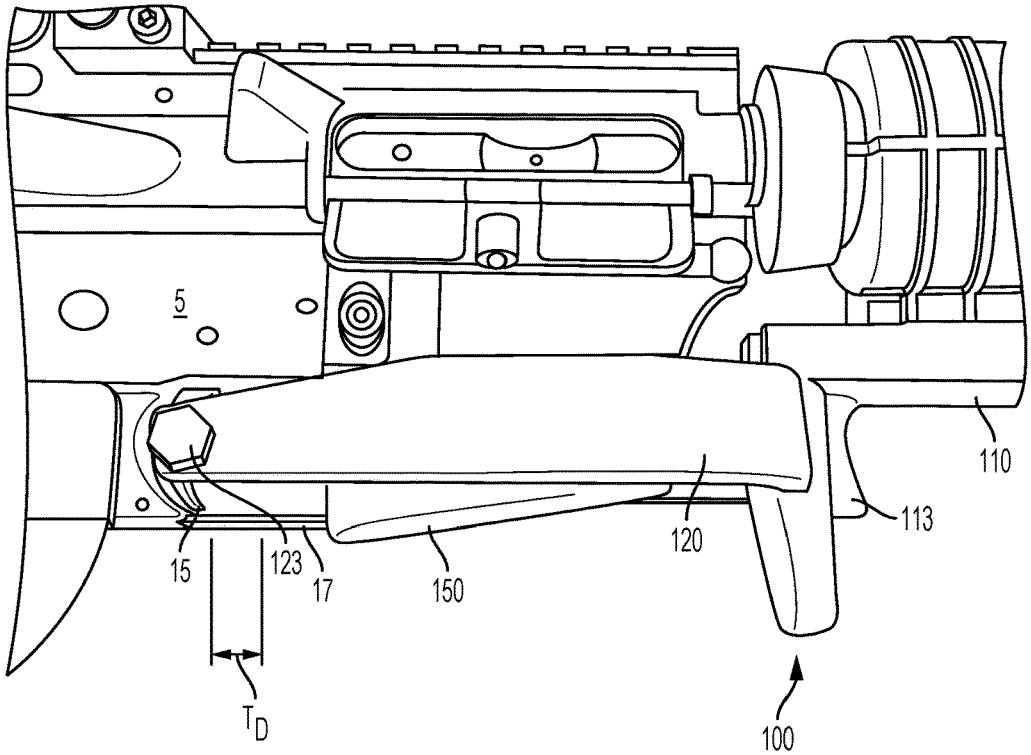
FIG. 4B illustrates a further close-up view of rear portions of the rapid-fire accessory on the semi-automatic firearm in the fired configuration of FIG. 2B, in accordance with various embodiments.

FIGS. 4A and 4B are close-up views of a rear portion of the rapid-fire accessory 100 mounted on the semi-automatic firearm 5 shown in FIGS. 1-2B, in accordance with various embodiments. The rear portion of the rapid-fire accessory 100 includes the actuator support structure 120. FIG. 4A illustrates the semi-automatic firearm 5 in the loaded configuration, while FIG. 4B illustrates the semi-automatic firearm 5 in the fired configuration, corresponding to FIGS. 2A and 2B, respectively.

In accordance with various embodiments, as the operator (e.g., operator 60 in FIG. 1) pushes the semi-automatic firearm 5 from the loaded configuration toward the fired configuration, while holding still the rapid-fire accessory 100, the trigger 15 engages the trigger actuator 123. Further relative movement toward the fired configuration causes the trigger actuator 123 to hold back the trigger 15 while the rest of the semi-automatic firearm 5 continues to move forward, which acts to pull the trigger 15. During that relative movement, the trigger actuator 123 moves generally parallel to a trigger guard 17 of the semi-automatic firearm 5. In this way, once the trigger 15 is moved (i.e., pivoted) at least a trigger actuation distance $T_D$, the semi-automatic firearm 5 will discharge. The trigger actuation distance $T_D$ may be significantly shorter than sliding distance $S_D$ (see, FIGS. 2A and 2B), which corresponds to how far the rapid-fire accessory 100 slides relative to the semi-automatic firearm 5.

In accordance with various embodiments, the rapid-fire accessory 100 may include a magazine well bracket 150 configured to guide the movement between the semi-automatic firearm 5 and the rapid-fire base structure (i.e., the forend rail mount 110 together with the actuator support structure 120). The magazine well bracket 150 may be an optional element of the rapid-fire accessory 100. In this way, the rapid-fire base structure with only the trigger actuator 123 may be used as the rapid-fire accessory 100. The magazine well bracket 150 may be sized to securely wrap around and remain generally fixed relative to the magazine well (e.g., magazine well 53 in FIG. 1) of the semi-automatic firearm 5. Once the magazine well bracket 150 is mounted on the magazine well and the rapid-fire base structure is also mounted on the semi-automatic firearm 5, the magazine well bracket 150 may be disposed between the magazine well and the actuator support structure 120. The magazine well bracket 150 may be configured to move with the magazine well when the semi-automatic firearm 5 moves relative to the rapid-fire base structure. In this way, the magazine well bracket 150 will move relative to the rest of the rapid-fire accessory 100. For example, in FIG. 4A a rear portion of the magazine well bracket 150 is almost vertically aligned with the trigger actuator 123, while in FIG. 4B the rear portion of the magazine well bracket 150 is horizontally spaced away from the trigger actuator 123.

Figure 5:
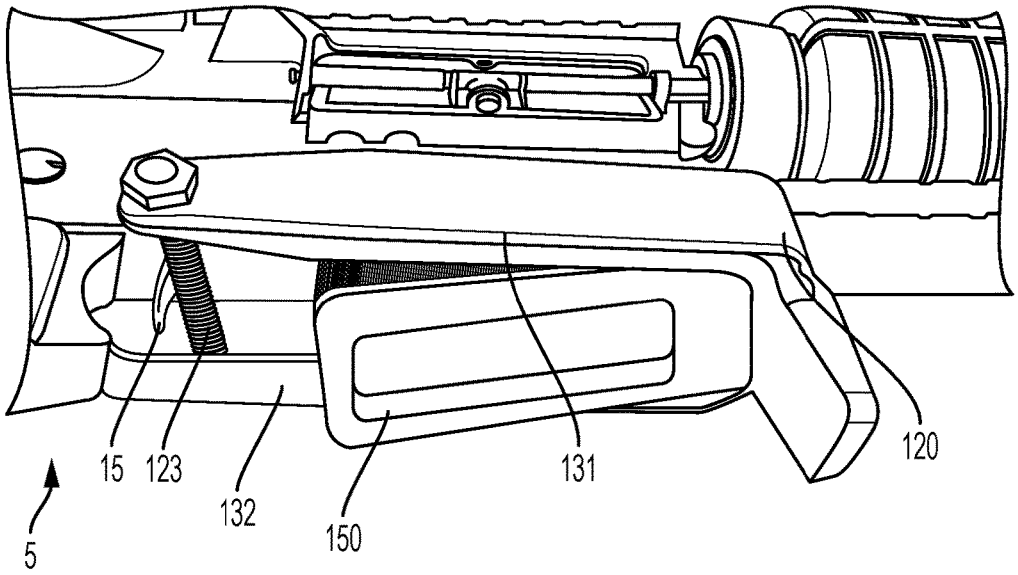
FIG. 5 illustrates a close-up side perspective view of rear portions of the rapid-fire accessory on the semi-automatic firearm in the fired configuration of FIGS. 2B and 4B, in accordance with various embodiments.

FIG. 5 is a close-up illustration of the rear portion of the rapid-fire accessory 100 mounted on the semi-automatic firearm 5, viewed from below and from a right side, in accordance with various embodiments. As illustrated, the trigger actuator 123 may be formed as a trigger bar extending laterally across the trigger 15 for engaging a forward facing side of the trigger 15. In addition, the actuator support structure 120 may include a first support arm 131 disposed on one side of the semi-automatic firearm (e.g., the right side) and a second support arm 132 disposed on the opposed side of the semi-automatic firearm (e.g., the left side). Both the first and second support arms 131, 132 may support the trigger actuator 123.

Figure 6:
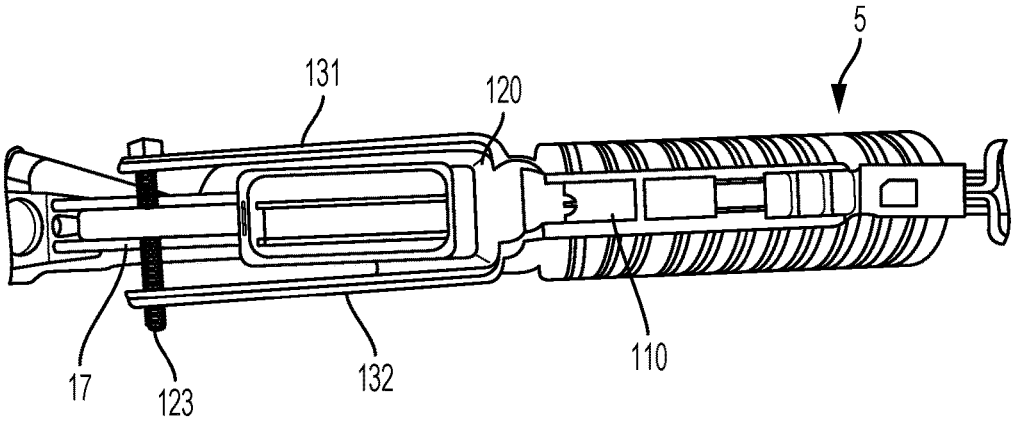
FIG. 6 illustrates a bottom view of the rapid-fire accessory on the semi-automatic firearm in the fired configuration of FIGS. 2B, 4B and 5, in accordance with various embodiments.

FIG. 6 is a bottom view illustrating the rapid-fire base structure, with the trigger actuator 123 installed thereon, mounted on the semi-automatic firearm 5, in accordance with various embodiments. The trigger actuator 123 may be a removably secured element (e.g., a locking bar or pin) held in an opposed pair of apertures (e.g., first and second apertures 121, 122 in FIG. 9), each formed in one of the first and second support arms 131, 132. The trigger actuator 123 may be pressure-fit in one or both of the apertures. A first aperture may be disposed in the first support arm 131 and a second aperture may be disposed opposite the first aperture in the second support arm 132. The trigger actuator 123 may be removed in order to install the rapid-fire accessory 100 on the semi-automatic firearm 5. Once the forend rail mount 110 is fully mounted on the forend rail (e.g., accessory rail 34 in FIGS. 3A and 3B), the trigger actuator 123 may be inserted into the opposed pair of apertures.

In FIG. 6, the rapid-fire accessory 100 does not include the above-noted magazine well bracket, which is optional. As a further alternative, in lieu of the magazine well bracket, the first and second support arms 131, 132 may be formed to more snuggly wrap around the magazine well of the semi-automatic firearm 5, which may help guide the sliding movement of the rapid-fire accessory 100.

As illustrated, the trigger actuator 123 may be a bolt that extends laterally between the first and second support arms 131, 132. Alternatively, the trigger actuator 123 may be a crossbar, pin, or other element that acts to engage the trigger 15 when the semi-automatic firearm 5 is pushed forward. The trigger actuator 123 may be fixed relative to the forend rail mount 110 by the first and second support arms 131, 132 that extend parallel to one another and rearward from the forend rail mount 110 toward the trigger 15. A rear end of each of the first and second support arms 131, 132 may include a lateral aperture (covered by the trigger actuator 123 in FIGS. 4A-5) configured to receive the trigger actuator 123. At least one of the lateral apertures may include an internal threading sized to receive an external threading of the trigger actuator 123. Additionally and/or alternatively, an appropriately sized nut (not illustrated) may be threaded onto one end of the trigger actuator 123 in order to prevent the trigger actuator 123 from sliding out of the lateral apertures. The lateral apertures are positioned to align the trigger actuator 123 to extend across an open space forward of the trigger 15 and inside the trigger guard 17.

Figure 7A:
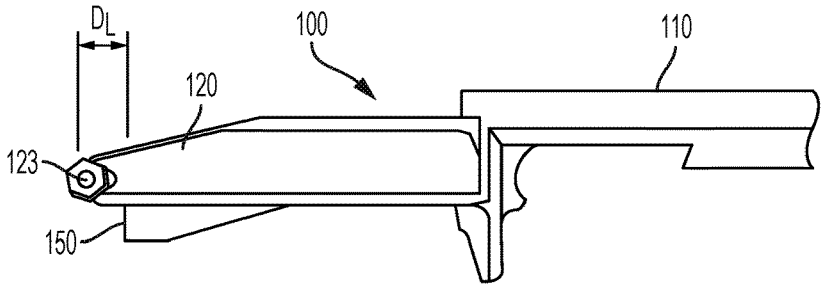
FIG. 7A illustrates a right view of a rapid-fire accessory in a loaded configuration in accordance with various embodiments.
Figure 7B:
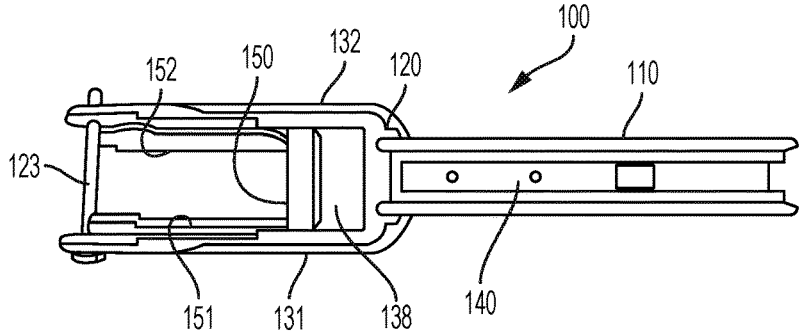
FIG. 7B illustrates a top view of the rapid-fire accessory of FIG. 7A in accordance with various embodiments.
Figure 8A:
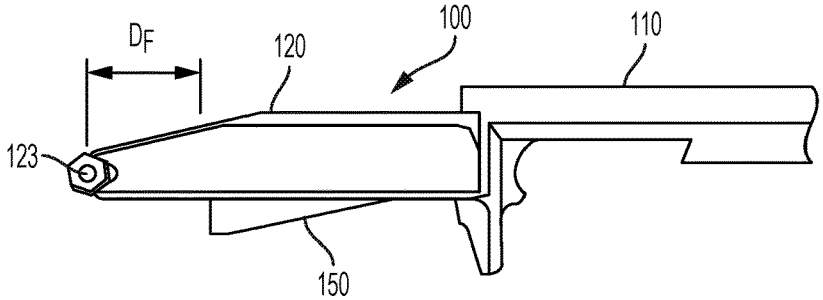
FIG. 8A illustrates a right side view of the rapid-fire accessory of FIGS. 7A and 7B, but in a fired configuration in accordance with various embodiments.
Figure 8B:
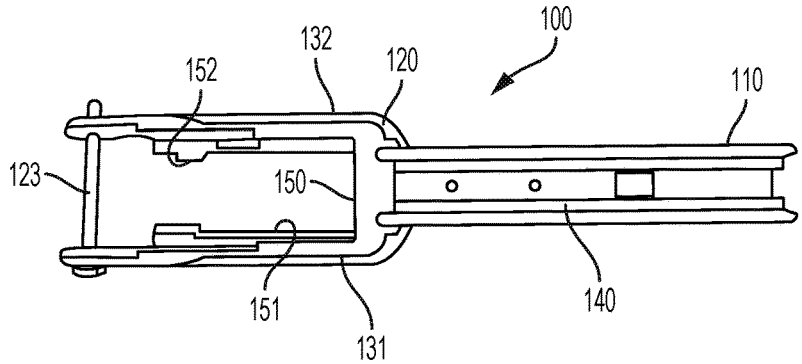
FIG. 8B illustrates a top view of the rapid-fire accessory of FIG. 8A in accordance with various embodiments.

FIGS. 7A-8B illustrate the rapid-fire accessory 100 without the semi-automatic firearm. In addition, FIGS. 7A-8B illustrate further details of the rapid-fire accessory 100, particularly the magazine well bracket 150 in relation to the rapid-fire base structure (i.e., the forend rail mount 110 together with the actuator support structure 120) and the trigger actuator 123. FIGS. 7A and 7B are side elevation and top views, respectively, of the rapid-fire accessory 100. In FIGS. 7A and 7B, the magazine well bracket 150 is in a rearward position relative to the rapid-fire base structure. In the rearward position, there may be a gap 138 between a forward edge of the magazine well bracket 150 and either a forward portion of the actuator support structure 120 or a rearward portion of the forend rail mount 110. When the rapid-fire accessory 100 is mounted on the semi-automatic firearm, the rearward position shown in FIGS. 7A and 7B may correspond to the loaded configuration (e.g., FIGS. 1, 2A, 3A, 4A). In contrast, FIGS. 8A and 8B are also side elevation and top views, respectively, of the rapid-fire accessory 100. In FIGS. 8A and 8B, the magazine well bracket 150 is in a forward position relative to the rapid-fire base structure. When the rapid-fire accessory 100 is mounted on the semi-automatic firearm, the forward position shown in FIGS. 8A and 8B may correspond to the fired configuration (e.g., FIGS. 1, 2B, 3B, 4B).

The magazine well bracket 150 may be configured to slide in a forward/backward direction relative to the rapid-fire base structure and the trigger actuator 123. In the forward position, as shown in FIGS. 7A and 7B, the rear edges of the magazine well bracket 150 may be either in contact with or at least a first, relatively small, distance $D_L$ (see, FIG. 7A) from the trigger actuator 123. In contrast, in the rearward position, as shown in FIGS. 8A and 8B, the rear edges of the magazine well bracket 150 may be spaced away from the trigger actuator 123 by a second distance $D_F$ (see, FIG. 8A), which is smaller than the first distance $D_L$.

Figure 11A:
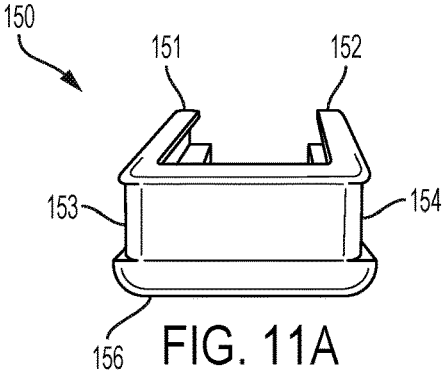
FIGS. 11A-11E illustrate front, rear, top, side, and perspective views, respectively, of the magazine well bracket 150 alone, in accordance with various embodiments.
Figure 11B:
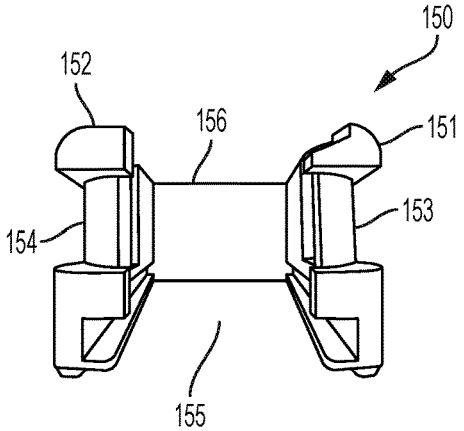
Figure 11C:
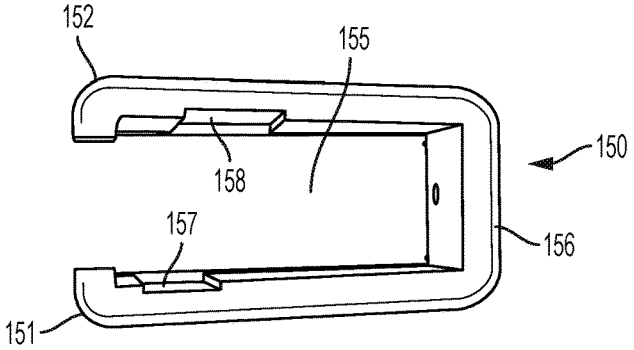
Figure 11D:
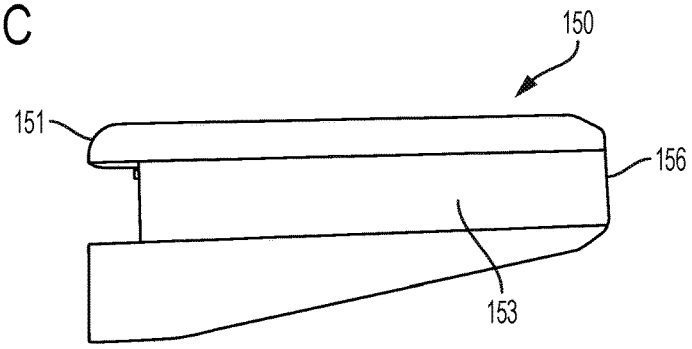
Figure 11E:
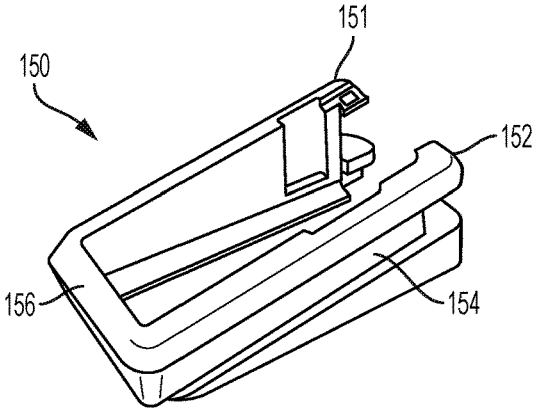

From the top view, as shown in FIGS. 7B, 8B, and 11C, the magazine well bracket 150 may have a U-shape. In this way, the magazine well bracket 150 may be formed by a first extension arm 151 extending parallel to and offset from a second extension arm 152, both connected by a forward wall of the magazine well bracket 150. The first extension arm 151 may directly engage and slide relative to the first support arm 131. Similarly, the second extension arm 152 may directly engage and slide relative to the second support arm 132. The top views of FIGS. 7B and 8B also illustrate the mounting channel 140 extending longitudinally in the forend rail mount 110.

Figure 9:
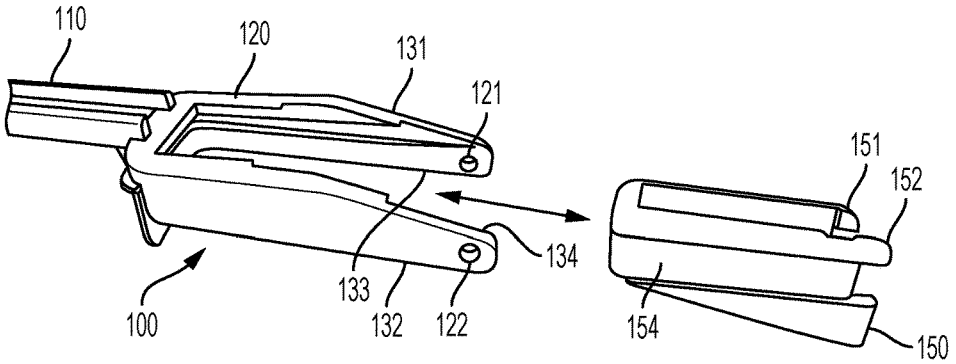
FIG. 9 illustrates an exploded side perspective view of the forend rail mount together with the actuator support structure separated from the magazine well bracket, in accordance with various embodiments.

FIG. 9 illustrates an exploded side perspective view of the rapid-fire base structure (i.e., the forend rail mount 110 together with the actuator support structure 120) separated from the magazine well bracket 150, in accordance with various embodiments. Inner portions of the actuator support structure 120 may be configured to loosely mate with outer portions of the magazine well bracket. In particular, the first and second support arms 131, 132 may include first and second rails 133, 134, respectively, that protrude inwardly. The first and second rails 133, 134 may be configured to slide in corresponding longitudinally extending grooves (e.g., grooves 153, 154 in FIG. 11B) on the outside of the first and second extension arms 151, 152 of the magazine well bracket 150. The first and second rails 133, 134 may extend longitudinally in the forward/backward direction in order to accommodate a full range of sliding motion of the magazine well bracket 150. Alternatively, the first and second extension arms 151, 152 may include outwardly protruding rails or tabs configured to be received by longitudinally extending grooves in the first and second support arms 131, 132.

In order to separate the rapid-fire base structure from the magazine well bracket 150, the trigger actuator (e.g., 123) may be removed from the first and second apertures 121, 122 in the first and second support arms 131, 132. Once the trigger actuator is removed, the magazine well bracket 150 may be slide completely out of (i.e., separated from) the actuator support structure 120.

FIGS. 10A-10F illustrate front, rear, top, side, front perspective, and rear perspective views, respectively, of the rapid-fire base structure (i.e., the forend rail mount 110 together with the actuator support structure 120) alone.

Figure 10A:
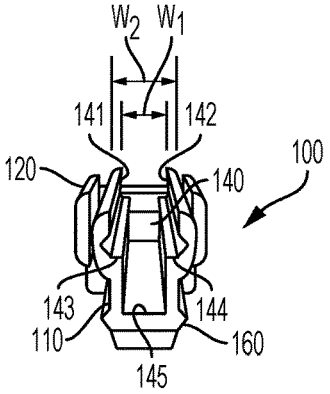
FIGS. 10A-10F illustrate front, rear, top, side, front perspective, and rear perspective views, respectively, of the rapid-fire base structure (i.e., the forend rail mount together with the actuator support structure) alone, in accordance with various embodiments.

FIG. 10A illustrates various aspects of the forend rail mount 110 of the rapid-fire accessory 100, in accordance with various embodiments. For example, a lower forward portion of the forend rail mount 110 may include a supplemental accessory rail 160. The supplemental accessory rail 160 may be used for attaching firearm accessories in-place of the conventional accessory rail, which may be mounted in the mounting channel 140, according to various embodiments. The supplemental accessory rail 160 may be shorter than a conventional accessory rail or optionally extend all the way to the actuator support structure 120.

FIG. 10A also illustrates that the mounting channel 140 may be formed by a first inner lateral wall 141 extending parallel and opposed to a second inner lateral wall 142. A first width $W_1$ between the first and second inner lateral walls 141, 142 may be slightly larger than a first lateral width of a conventional accessory rail (e.g., accessory rail 34 in FIGS. 2A and 2B) of the semi-automatic firearm. In addition, each of the first and second inner lateral walls 141, 142 may include longitudinally extending grooves 143, 144. The longitudinally extending grooves 143, 144 may form a second width $W_2$ in the first and second inner lateral walls 141, 142 that is wider that the first width $W_1$. A lower portion of the conventional accessory rail typically bulges outwardly to a second lateral width that is wider than the first lateral width (e.g., similar to the supplemental accessory rail 160). In this way, the grooves 143, 144 are configured to loosely receive and guide movement of the bulging lower portion of the conventional accessory rail therein. In accordance with various embodiments, a lower floor of the mounting channel 140 may optionally include a recess 145. Providing the recess 145 may reduce the overall weight of the rapid-fire base structure.

Figure 10B:
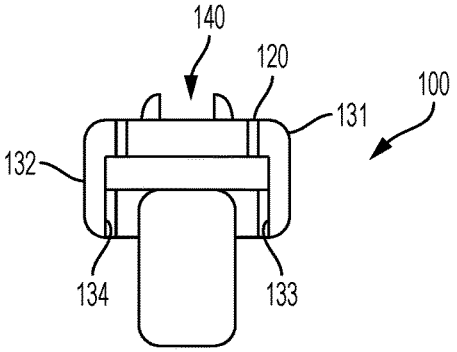
Figure 10C:
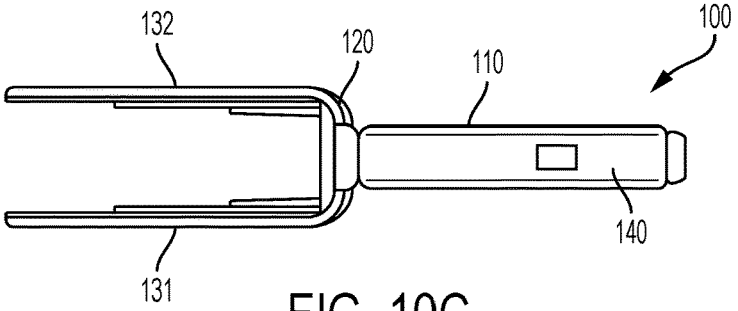

FIG. 10B illustrates various aspects of the actuator support structure 120 of the rapid-fire accessory 100, in accordance with various embodiments. For example, the first and second rails 133, 134 may be have a rectangular cross-section, protruding inwardly from the first and second support arms 131, 132, respectively. Also, the first and second support arms 131, 132 may be symmetrically offset, laterally, from a longitudinal centerline of the mounting channel 140, which is also shown in FIG. 10C.

Figure 10D:
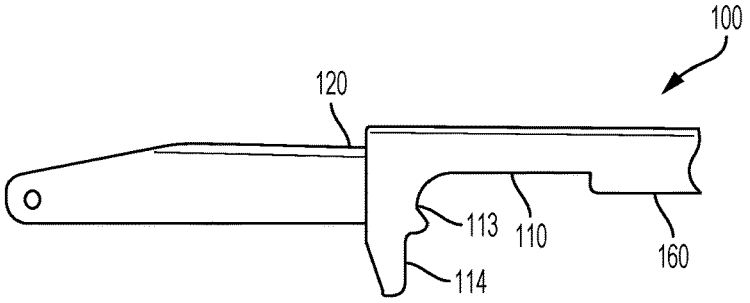
Figure 10E:
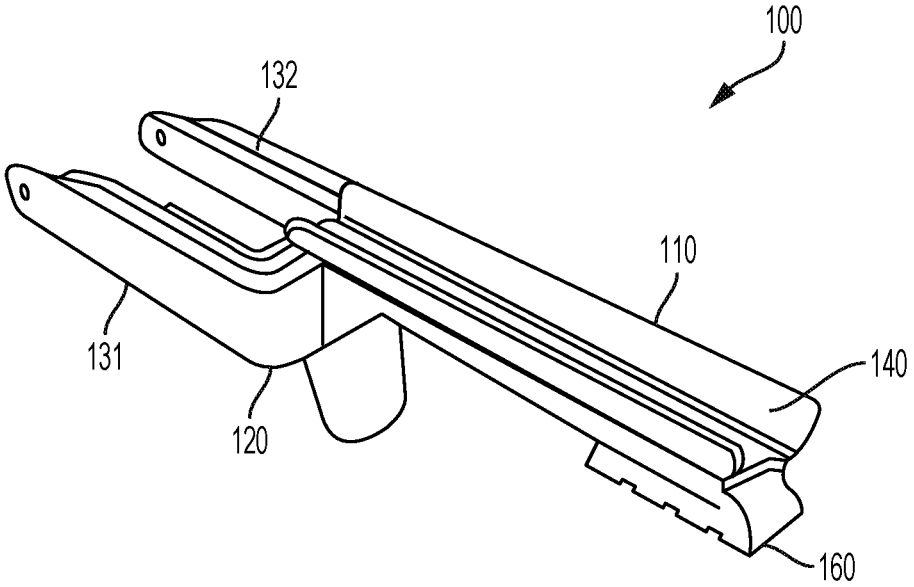
Figure 10F:
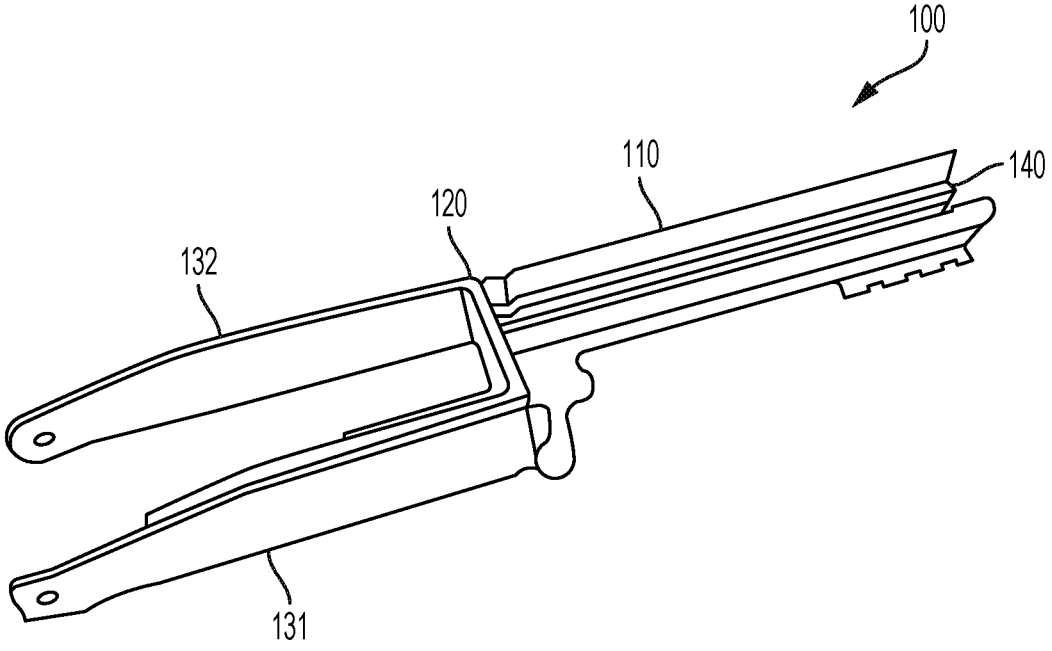

FIGS. 10D-10F illustrates various additional aspects of the rapid-fire accessory 100, in accordance with various embodiments. For example, a longitudinal extent of the forend rail mount 110 may be vertically offset from a longitudinal extent of the actuator support structure 120. In addition, an underside of the rapid-fire base structure may include one or more finger/hand rest surfaces, such as the forward-facing edge 113 or the lower protruding horn 114. Further, the supplemental accessory rail 160 may be disposed at a forward edge of the rapid-fire base structure. Alternatively, the supplemental accessory rail 160 either need not be included or may be offset rearward from the forward edge of the rapid-fire base structure, or extend further along the underside of the forend rail mount 110.

FIGS. 11A-11E illustrate front, rear, top, side, and perspective views, respectively, of the magazine well bracket 150 alone. As shown, the magazine well bracket 150 may have a first extension arm 151 extending parallel to and offset from a second extension arm 152, both connected by a forward wall 156 of the magazine well bracket 150. A central section 155 of the magazine well bracket 150 is configured to receive the magazine well of the semi-automatic firearm. The first and second extension arms 151, 152 may including a first and second groove 153, 154, respectively that extend longitudinally along an outer surface of the first and second extension arms 151, 152. The first and second grooves 153, 154 may be configured to receive the first and second rails (e.g., first and second rails 133, 134) of the actuator support structure 120.

In accordance with various embodiments, the rapid-fire accessory 100 may be installed on the semi-automatic firearm in either a fully or a partially disassembled state. For example, if the magazine well bracket 150 is included, the magazine well bracket 150, alone, may first be mounted on the magazine well of the semi-automatic firearm before installing the rapid-fire base structure and the trigger actuator. In various embodiments, the magazine well bracket 150 may include vertical grooves 157, 158 (see FIG. 11C) configured to mate with outer elements of the magazine well for holding the magazine well bracket 150 from sliding in the forward or rearward directions once installed. In this way, the magazine well bracket 150 may be slid vertically onto the magazine well for installation. The magazine well bracket 150 may be configured to loosely wrap around the magazine well and thus may need to be held in-place until installation of the rapid-fire base structure. After installation of the magazine well bracket 150 and with the trigger actuator 123 removed, the rapid-fire base structure may be slid onto both the accessory rail (e.g., 34) of the semi-automatic firearm and the first and second grooves 153, 154 of the magazine well bracket 150. In this way, the accessory rail gets inserted into the mounting channel. Also, the first and second rails 133, 134 of the actuator support structure 120 may be slid into the first and second grooves 153, 154 of the magazine well bracket 150. Being mounted on the accessory rail will generally hold the rapid-fire base structure and the magazine well bracket 150 to the semi-automatic firearm, while allowing the rapid-fire base structure to slide relative to both the magazine well bracket 150 and the semi-automatic firearm. Once the first and second support arms 131, 132 are positioned, such that the lateral apertures 121, 122 are aligned inside the trigger guard of the semi-automatic firearm, the trigger actuator 123 may be installed in the lateral apertures 121, 122. The trigger actuator 123 may thus be inserted through a first lateral aperture 121 in the first support arm 131, extending toward an opposite side of the semi-automatic firearm 5, and through a second lateral aperture 122 in the second support arm 132.

The trigger actuator 123 may be held in-place in the lateral apertures 121, 122 with a nut screwed onto threads at one end of the trigger actuator 123 or through a simple friction fit. Further still, the trigger actuator 123 may be formed as a push button pin or other quick release pin. Alternatively, further fixation elements may be provided on or with the trigger actuator 123 such as a hair pin style locking pin, a ball lock pin, or double ball detent pins.

Figure 12A:
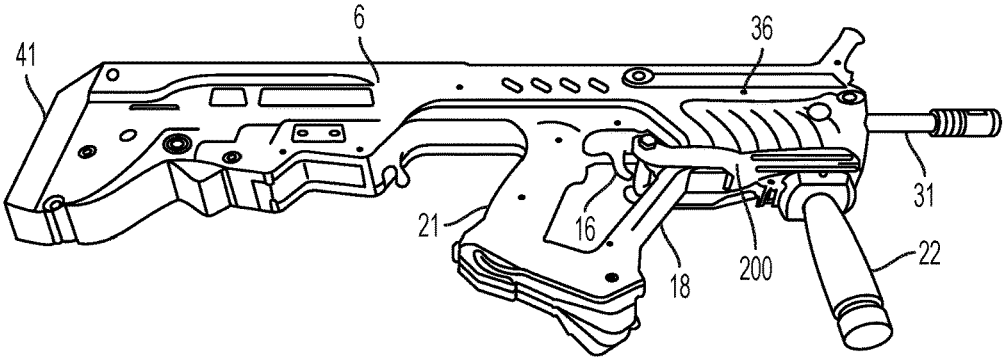
FIG. 12A illustrates another rapid-fire accessory mounted on a different semi-automatic firearm, in accordance with various embodiments.

FIG. 12A illustrates a rapid-fire accessory 200 mounted on a different semi-automatic firearm 6, in accordance with various embodiments. The semi-automatic firearm 6 illustrated is a Tavor (i.e., such as those produced by Israel Weapon Industries (IWI)) style weapon that includes a trigger 16, a pistol grip 21, a barrel 31, a forend 36, and a stock 41. The semi-automatic firearm 6 may include a magazine (not included in the illustration) for holding ammunition. Other features common to a Tavor style weapon, as well as other semi-automatic firearms are illustrated, such as a removable forward grip 22.

Figure 12B:
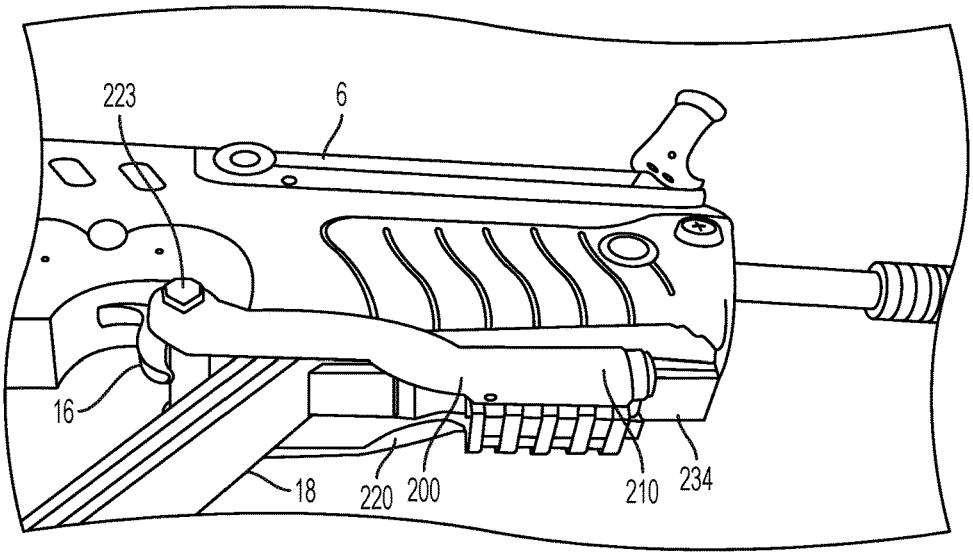
FIG. 12B illustrates a close-up view of the rapid-fire accessory mounted on the semi-automatic firearm in FIG. 12A, in accordance with various embodiments.

FIG. 12B illustrates a close-up view of the rapid-fire accessory 200 mounted on the semi-automatic firearm 6 in FIG. 12A, but in the fired configuration. In FIG. 12A, the semi-automatic firearm 6 is in the loaded configuration, with the trigger 16 of the semi-automatic firearm 6 in a forward position. From the loaded configuration, pulling the trigger 16 (i.e., pivoting or moving the trigger 16 rearward—toward the left as illustrated) will discharge the semi-automatic firearm 6. From the loaded configuration, to bump fire in accordance with various embodiments, an operator holds the rapid-fire accessory 200 in a relatively fixed position while pushing the semi-automatic firearm 6 forward into the fired configuration (i.e., FIG. 12B), which discharges the semi-automatic firearm 6. The semi-automatic firearm 6 sliding forward relative to the rapid-fire accessory 200 also means the rapid-fire accessory 200 slides rearward relative to the semi-automatic firearm 6 between the loaded and fired configurations. This relative sliding movement causes the trigger actuator 223 (see FIG. 12B) to engage a forward side of the trigger 16, pushing the trigger 16 rearward (i.e., "pulling the trigger"), which discharges the semi-automatic firearm 6. Alternatively, to bump fire in accordance with various embodiments, starting from the loaded configuration an operator may hold the semi-automatic firearm 6 in a relatively fixed position, while pulling the rapid-fire accessory 200 rearward, until the semi-automatic firearm 6 is in the fired configuration, which discharges the semi-automatic firearm 6.

The rapid-fire accessory 200 additionally includes a trigger actuator 223 for pulling the trigger 16 of the semi-automatic firearm 6. The trigger actuator 223 is fixed relative to the forend rail mount 210 by an actuator support structure 220, which extends rearward from the forend rail mount 210 toward the trigger 16. The forend rail mount 210 may be fixedly secured to or integrally formed with the actuator support structure 220. The trigger actuator 223 is configured to engage a forward side of the trigger 16, applying a rearward force thereon, until the trigger 16 moves (e.g., pivots) enough to discharge the semi-automatic firearm 6. The trigger actuator 223 may be a removably secured element (e.g., a locking bar or pin) held in an opposed pair of apertures (e.g., first aperture 221 in FIG. 14D and second aperture 222 in FIG. 14C), each formed in one of the first and second support arms 231, 232. The trigger actuator 223 may be pressure-fit in one or both of the apertures. A first aperture may be disposed in the first support arm 231 and a second aperture may be disposed opposite the first aperture in the second support arm 232. The trigger actuator 223 may be removed in order to install the rapid-fire accessory 200 on the semi-automatic firearm 6. Once the forend rail mount 210 is fully mounted on the add-on accessory rail (e.g., add-on accessory rail 234 in FIGS. 15A and 15B), the trigger actuator 223 may be inserted into the opposed pair of apertures.

In accordance with various embodiments, the rapid-fire accessory 200 includes a forend rail mount 210 for attaching the rapid-fire accessory 200 to the semi-automatic firearm 6. The forend rail mount 210 is a forward portion of the rapid-fire accessory 200, which attaches to the semi-automatic firearm 6 by sliding or otherwise mounting the forend rail mount 210 onto an add-on accessory rail 234 of the forend 36 of the semi-automatic firearm 6. The forend rail mount 210 includes a longitudinally mounting channel (e.g., mounting channel 240 in FIGS. 14A-14D) for receiving the add-on accessory rail 234.

Figure 13:
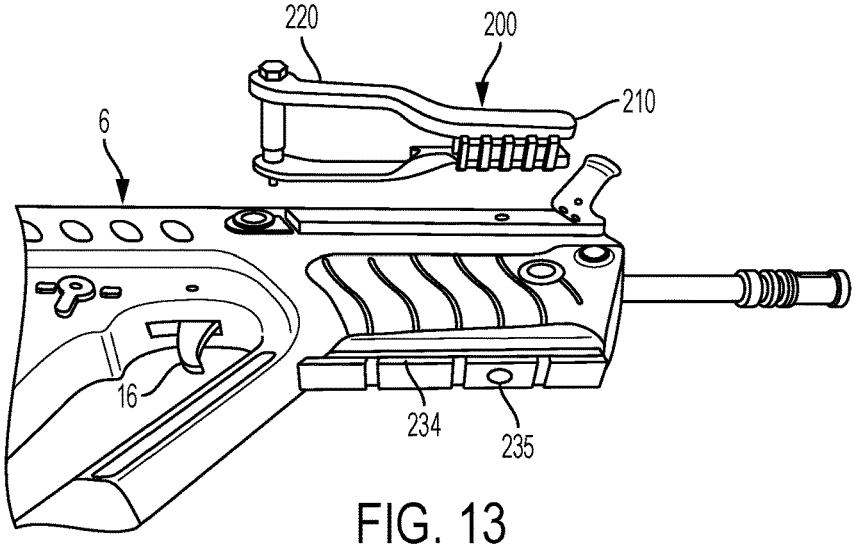
FIG. 13 illustrates the rapid-fire accessory, in FIGS. 12A and 12B, removed from the semi-automatic firearm.

FIG. 13 illustrates the rapid-fire accessory 200, shown in FIGS. 12A and 12B, removed from the semi-automatic firearm 6. In accordance with various embodiments, an add-on accessory rail 234 may be provided to accommodate semi-automatic firearms that do not include an accessory rail on the underside of the forend. For example, unlike many AR-15 style weapons (e.g., FIG. 1), the Tavor style weapons typically do not include an accessory rail on the underside of the forend 36. Thus, in accordance with various embodiments, the add-on accessory rail 234 may be secured to the underside of the forend of many semi-automatic weapons. For example, the underside of the forend 36 on many Tavor style weapons may include a threaded screw hole, which can be used to secure accessories, such as the removable forward grip (see, 22 in FIG. 12A). Thus, the add-on accessory rail 234 may include an aperture 235 that may align with such a threaded screw hole on the underside of the forend 36. A fastener, like a screw, threaded into the aperture 235 may be used to secure the add-on accessory rail 234 to the forend 36.

FIGS. 14A-14D illustrate front, rear, top, front perspective, and rear perspective views, respectively, of the rapid-fire accessory 200 alone.

Figure 14A:
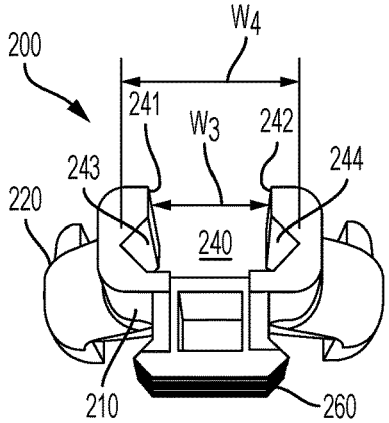
FIGS. 14A-14D illustrate front, rear, front perspective, and rear perspective views, respectively, of the rapid-fire accessory of FIGS. 12A-13, alone, in accordance with various embodiments.

FIG. 14A illustrates various aspects of the forend rail mount 210 of the rapid-fire accessory 200, in accordance with various embodiments. For example, a lower forward portion of the forend rail mount 210 may include a supplemental accessory rail 260. The supplemental accessory rail 260 may be used for attaching firearm accessories, such as the removable forward grip (see, 22 in FIG. 12A), according to various embodiments. The supplemental accessory rail 260 may be shorter than the add-on accessory rail (see 234 in FIGS. 15A and 15B).

FIG. 14A also illustrates that the mounting channel 240 may be formed by a first inner lateral wall 241 extending parallel and opposed to a second inner lateral wall 242. A first width $W_3$ between the first and second inner lateral walls 241, 242 may be slightly larger than a first lateral width $W_5$ of the add-on accessory rail (see, add-on accessory rail 234 in FIG. 15B). In addition, each of the first and second inner lateral walls 241, 242 may include longitudinally extending grooves 243, 244. The longitudinally extending grooves 243, 244 may form a second width $W_4$ in the first and second inner lateral walls 241, 242 that is wider that the first width $W_3$. A lower portion of the add-on accessory rail bulges outwardly to a second lateral width that is wider than the first lateral width. In this way, the grooves 243, 244 are configured to loosely receive and guide movement of the bulging lower portion of the add-on accessory rail 234 therein.

Figure 14B:
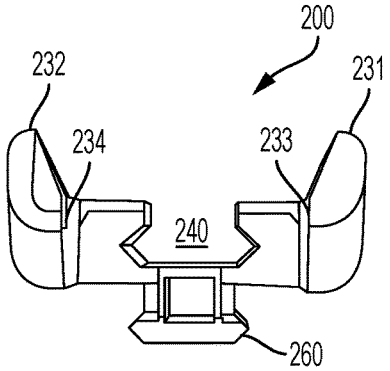

FIG. 14B illustrates various aspects of the actuator support structure 220 of the rapid-fire accessory 200, in accordance with various embodiments. For example, the first and second support arms 131, 132 may be symmetrically offset, laterally, from a longitudinal centerline of the mounting channel 240. In addition, the first and second support arms 131, 132, may have first and second guide surfaces 233, 234, respectively on an inside of the first and second support arms 131, 132. The first and second guide surfaces 233, 234 may be configured to stabilize the forward and backward movement of the rapid-fire accessory 200 on opposed lateral sides of the trigger guard (see, trigger guard 18 in FIGS. 12A and 12B).

Figure 14C:
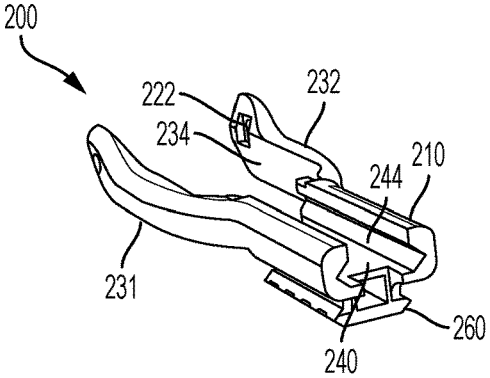
Figure 14D:
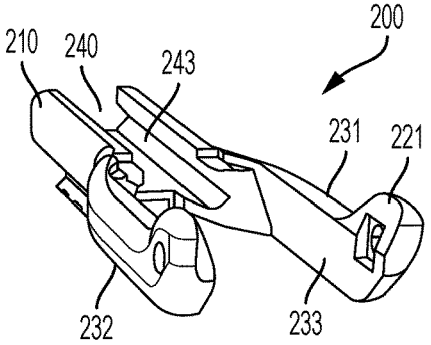

FIGS. 14C and 14D illustrates various additional aspects of the rapid-fire accessory 200, in accordance with various embodiments. For example, the supplemental accessory rail 260 may be disposed at a forward edge of the rapid-fire accessory 200. Alternatively, the supplemental accessory rail 160 either need not be included or may be offset rearward from the forward edge of the rapid-fire accessory 200, or extend further along the underside of the forend rail mount 210.

Figure 15A:
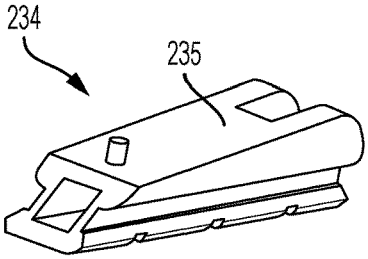
FIGS. 15A and 15*b* illustrate perspective and front views, respectively, of the add-on accessory rail, alone, in accordance with various embodiments.
Figure 15B:
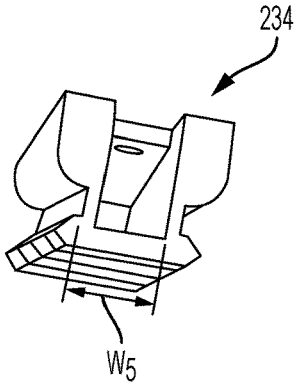

FIGS. 15A and 15B illustrate perspective and front views, respectively, of the add-on accessory rail 234.

The rapid-fire accessories 100, 200 may be formed by molding, 3-D printing, and/or an assembly of parts. In addition, the rapid-fire accessories 100, 200 may be formed of metal, high-impact polymer, other suitable materials, or any combination thereof. Alternatively, in accordance with various embodiments, the sliding surfaces of the rapid-fire accessories 100, 200 may be enhanced with low-friction coatings, lubricants, and/or bearing assemblies.

The foregoing descriptions are provided merely as illustrative examples and are not intended to require or imply that the elements of various embodiments are required. Further, any reference to claim elements in the singular, for example, using the articles "a," "an" or "the" is not to be construed as limiting the element to the singular.

While the terms such as "first" and "second" are used herein to describe similarly named elements, such identifiers are merely for convenience and are not meant to limit various embodiments to a particular order, sequence, type of network or carrier.

The rapid-fire accessory in accordance with various embodiments provides an easy-to-use device that may enable an operator to bump fire a semi-automatic firearm more easily than free hand techniques. In addition, the rapid-fire accessory in accordance with various embodiments does not demand significant modification of the semi-automatic firearm, such as replacement of the pistol grip, stock, and/or other elements. In this way, operators may keep their favorite original, replacement, or aftermarket stock and/or pistol grip. The rapid-fire accessory in accordance with various embodiments is also quick and easy to install without requiring special tools. Further, the rapid-fire accessory in accordance with various embodiments is not bulky, is relative small, and may be manufactured relatively inexpensively.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

What is claimed is:

1. A rapid-fire accessory for a semi-automatic firearm, comprising:

a forend rail mount configured to attach the rapid-fire accessory to the semi-automatic firearm, wherein the forend rail mount includes a mounting channel for receiving an accessory rail extending along a forend of the semi-automatic firearm, wherein when mounted in the mounting channel the accessory rail guides a sliding movement of the rapid-fire accessory along the accessory rail;

a trigger actuator configured to pull a trigger of the semi-automatic firearm, wherein the trigger actuator moves in unison with the sliding movement of the forend rail mount and is configured to move the trigger rearward from a forward position to a pulled position that discharges the semi-automatic firearm; and a magazine well bracket configured to wrap around a magazine well of the semi-automatic firearm, wherein when mounted on the magazine well of the semi-automatic firearm the magazine well bracket is configured to be disposed between the magazine well and a support structure of the trigger actuator;

wherein the support structure of the trigger actuator extends rearward from a distal end closest to the forend rail mount to a proximal end closest to the trigger, wherein the trigger actuator further includes a trigger bar supported by the support structure of the trigger actuator and extending laterally across the trigger from one side of the semi-automatic firearm to an opposed side of the semi-automatic firearm.

2. The rapid-fire accessory of claim 1, wherein the support structure of the trigger actuator includes a first support arm disposed on the one side of the semi-automatic firearm and a second support arm disposed on the opposed side of the semi-automatic firearm, wherein the first and second support arms support the trigger bar.

3. The rapid-fire accessory of claim 2, wherein the trigger bar is secured to the first support arm and the second support arm.

4. The rapid-fire accessory of claim 1, wherein the magazine well bracket includes a guide track for guiding the sliding movement of the rapid-fire accessory.

5. The rapid-fire accessory of claim 1, wherein a sliding movement of the trigger actuator moves relative to the magazine well bracket and the magazine well.

6. The rapid-fire accessory of claim 2, wherein the trigger bar is removably secured to the support structure of the trigger actuator.

7. The rapid-fire accessory of claim 1, wherein an inner cross-sectional shape of the mounting channel conforms to an outer cross-sectional shape of the accessory rail.

8. The rapid-fire accessory of claim 1, wherein opposed lower portions of the mounting channel bulge outwardly forming opposed longitudinal grooves for receiving opposed lateral flanges on a lower portion of the accessory rail.

9. The rapid-fire accessory of claim 1, wherein the forend rail mount includes a forward hand grip surface configured to receive a forward hand of an operator of the semi-automatic firearm while the operator holds a pistol grip of the semi-automatic firearm with a rearward hand.

10. The rapid-fire accessory of claim 1, wherein the forend rail mount includes a supplemental accessory rail protruding from a lower side of the forend rail mount.

11. The rapid-fire accessory of claim 10, wherein the supplemental accessory rail includes a matching outer profile to the accessory rail extending along the forend of the semi-automatic firearm.

12. The rapid-fire accessory of claim 1, wherein the forend rail mount includes at least one finger grip contour.

13. A method of mounting a rapid-fire accessory on a trigger guard of a semi-automatic firearm, comprising:

mounting a magazine well bracket around a magazine well of the semi-automatic firearm; and mounting a forend rail mount of the rapid-fire accessory onto an accessory rail of the of the semi-automatic firearm, wherein the accessory rail extends along a forend of the semi-automatic firearm, wherein once the forend rail mount is mounted on the accessory rail, the accessory rail is disposed in a mounting channel of the forend rail mount, wherein the mounting channel guides a sliding movement of the forend rail mount forward and rearward relative to the forend, wherein the rapid-fire accessory includes a trigger actuator for engaging a trigger of the semi-automatic firearm, wherein the trigger actuator is fixed relative to the forend rail mount and configured to pull the trigger when the forend slides forward in the mounting channel, wherein the mounted magazine well bracket is disposed between the magazine well and a support structure of the trigger actuator;

wherein the support structure of the trigger actuator extends rearward from a distal end closest to the forend rail mount to a proximal end closest to the trigger, wherein the trigger actuator further includes a trigger bar supported by the support structure of the trigger actuator and extending laterally across the trigger from one side of the semi-automatic firearm to an opposed side of the semi-automatic firearm.

14. The method of claim 13, further comprising: securing a trigger bar to the support structure of the trigger actuator, wherein the support structure extends rearward from the distal end closest to the forend rail mount to the proximal end closest to the trigger, wherein the trigger bar, once secured to the support structure, extends laterally across the trigger from one side of the semi-automatic firearm to an opposed side of the semi-automatic firearm.

* * * * *